US005197763A

United States Patent [19]

Whalen

[11] Patent Number: 5,197,763

[45] Date of Patent: Mar. 30, 1993

[54] BIOMEDICAL INFORMATION CARD AND METHOD OF MAKING

[76] Inventor: Thomas E. Whalen, 221 NW. 120th St., Miami, Fla. 33168

[21] Appl. No.: 820,286

[22] Filed: Jan. 10, 1992

[51] Int. Cl.[5] ..... B42D 15/00

[52] U.S. Cl. ..... 283/76; 283/70; 283/109; 283/900

[58] Field of Search ..... 283/76, 900, 70, 75, 283/107, 109, 904; 428/13

[56] References Cited

U.S. PATENT DOCUMENTS

| | | | |
|---|---|---|---|
| D. 284,581 | 7/1986 | Peterson | 283/76 X |
| 3,792,542 | 2/1974 | Cohan | 283/76 |
| 3,810,566 | 5/1974 | Adams et al. | 283/900 X |
| 3,958,690 | 5/1976 | Gee, Sr. | 283/900 X |
| 4,236,332 | 12/1980 | Domo | 283/76 |
| 4,259,391 | 3/1981 | Brecht | 283/76 X |
| 4,318,554 | 3/1982 | Anderson et al. | 283/76 |
| 4,619,469 | 10/1986 | Grover | 283/76 |

*Primary Examiner*—Timothy V. Eley

*Assistant Examiner*—Willmon Fridie, Jr.

*Attorney, Agent, or Firm*—Malin, Haley, DiMaggio and Crosby

[57] ABSTRACT

An emergency medical data card for private individualized and convenient creation and the process of making thereof that can also be provided in a kit form so that individuals can create their own emergency medical data card. The emergency medical data card is created by initially providing a blank form that includes indicia having individualized, personalized information, such as name, address, and a series of medical indicia information that includes lines from each word so that an individual can fill in the particular information required, along with particular boxes that can be checked. The letter size form is then reduced a predetermined amount so that its size ultimatey is slightly smaller than a credit card which conveniently fits in a wallet. The sheet, once reduced, is then attached to a blank rigid plastic card that does say "Emergency Medical Data" on it permanently, all of which can be laminated together.

4 Claims, 3 Drawing Sheets

EMERGENCY MEDICAL DATA

12

FULL NAME _____
ADRESS _____
CITY _____
STATE _____ ZIP _____
BIRTHDATE _____ RELIGION _____
TELEPHONE _____
PLEASE NOTIFY _____
TELEPHONE _____ RELATION
OPTIONAL PERSON TO NOTIFY:
NAME _____
TELEPHONE _____ RELATION _____
PHYSICIAN _____ TELEPHONE _____
HEALTH INSURANCE CO. NAME _____
POLICY _____
☐ BLOOD TYPE IF KNOWN _____
☐ BLOOD PRESURE ☐ HIGH ☐ LOW
☐ HEPATITIS ☐ EMPHYSEMA ☐ KIDNEY OR LIVER DISORDER
☐ DIABETICS ☐ ANEMIA ☐ HEART TROUBLE ☐ PACEMAKER
☐ CONTACT LENSES
■ OTHER DISORDERS _____

☐ ALLERGIC TO: ■ PENICILLIN ☐ SULPHA
☐ OTHER ALLERGIES _____

☐ TAKING MEDICATION FOR _____

■ ORGAN DONOR ■ YES ☐ NO
☐ ORGAN DONOR AGENCY
NAME _____
PHONE _____

FIG.3.

BIOMEDICAL INFORMATION CARD AND METHOD OF MAKING

BACKGROUND OF THE INVENTION

1. Purpose of the Invention

This invention relates to a biomedical card that contains personalized medical emergency data regarding a particular human being and a very inexpensive and simple process for making a biomedical card that is completed by the individual described on the card for maximum convenience.

2. Description of the Prior Art

Indicia-bearing cards that have general information, including medical history, are known in the prior art. U.S. Pat. No. 4,259,391 issued to Brecht on Mar. 31, 1981 describes a transparent indicia-bearing plastic laminate which includes a medical history of a patient. U.S. Pat. No. 4,745,268 describes a personal identification card system which is wallet sized and laminated.

U.S. Pat. No. 4,814,594 issued to Drexler on Mar. 21, 1989 shows an updatable micrographic pocket data card that is wallet sized. Other cards are also shown in the prior art as combinations of medical health and identification for insurance purposes, such as in U.S. Pat. No. 4,632,428 issued to Brown on Dec. 30, 1986, U.S. Pat. No. 4,459,015 issued to Brecht on Jul. 10, 1984, and U.S. Pat. No. 4,318,554 issued to Anderson on Mar. 9, 1982. All of these cards show, in effect, an industrialized, commercialized, laminated card that is professionally accomplished using known technologies. One of the drawbacks is that the cards typically do not contain enough information and are also not simply done. Thus, the typical biomedical card that is professionally prepared is often an inconvenient process; most people do not invest the time to get the information to the appropriate professional agency.

The present invention overcomes these problems by providing a wallet-sized medical data card containing an extreme amount of information that can be prepared mostly in written longhand using a preformed page-sized form and a rigid wallet-sized backing card that includes indicia identifying emergency medical data along a prescribed area of the card and a second area on the card sized to receive a piece of paper that started out as a full page blank form with specific information that can be filled in, in longhand, by the user. Subsequently, the form is such that it can be reduced in size twice in a Xerography type machine that has the capability of 60% reduction, so that the end product has all the information filled in, in longhand, but is sized for wallet size and is quite legible. Once the reduced in size reproduction has taken place of the form paper, the card-sized paper is then joined with the laminate and backing card to form the medical data card. The process is such that an individual fills out his own form questionnaire in longhand or by typing.

In essence, the invention starts from a printed letter size form having predetermined questionnaire indicia for providing emergency medical data arranged in a predetermined order for subsequent reproduction, reduction in size, and attachment to a rigid backing card which is then laminated.

SUMMARY OF THE INVENTION

A wallet-sized medical data card and the method of making, comprising a medical data card containing information that begins on a letter-sized form that includes name, location, address, birth dates, particular medical information (such as Diabetes, heart trouble, disorders, allergies, organ donor, and the like), the indicia being of a predetermined size print that, upon reduction, will still be legible when twice reduced by at least 60% each time. The form is such that an individual fills in the blank spaces information requested by indicia or checks the appropriate box located on the form. The form, once filled in, can then be reduced using a conventional copy machine having reduction capability in a two-step reduction of 68% the first time and 65% the second time. This will reduce the letter-size form to wallet-size that is still legible that can fit on a rigid wallet-sized support card which has been prepared out of plastic or other rigid material in a rectangular shape. The rigid support card includes additional indicia preprinted in large print not scaled down called "Emergency Medical Data" placed on both sides or one side of the card in large, easy to see letters. The printed form questionnaire which has been reduced is then affixed to the plastic support card and held in place by laminating both the printed paper form questionnaire and the plastic card that is wallet-sized in final form.

It is an object of this invention to provide an improved medical card, wallet sized, that is low cost and can be done simply with the individual filling out the information directly onto a form for convenience.

It is another object of this invention to provide a method for making a low cost, high quality biomedical card that is wallet sized.

And yet another object of this invention is to provide a biomedical card that can be made simply with a standard letter size form that is filled in by the individual, a copy machine having reduction capability, and a preprinted, laminated or laminable support card.

The instant invention has been shown and described herein in what is considered to be the most practical and preferred embodiment. It is recognized, however, that departures may be made therefrom within the scope of the invention and that obvious modifications will occur to a person skilled in the art.

BRIEF DESCRIPTION OF THE DRAWINGS

FIG. 3 shows a full size form showing indicia used in the invention in a front elevational view.

PREFERRED EMBODIMENT OF THE INVENTION

Figure 1:
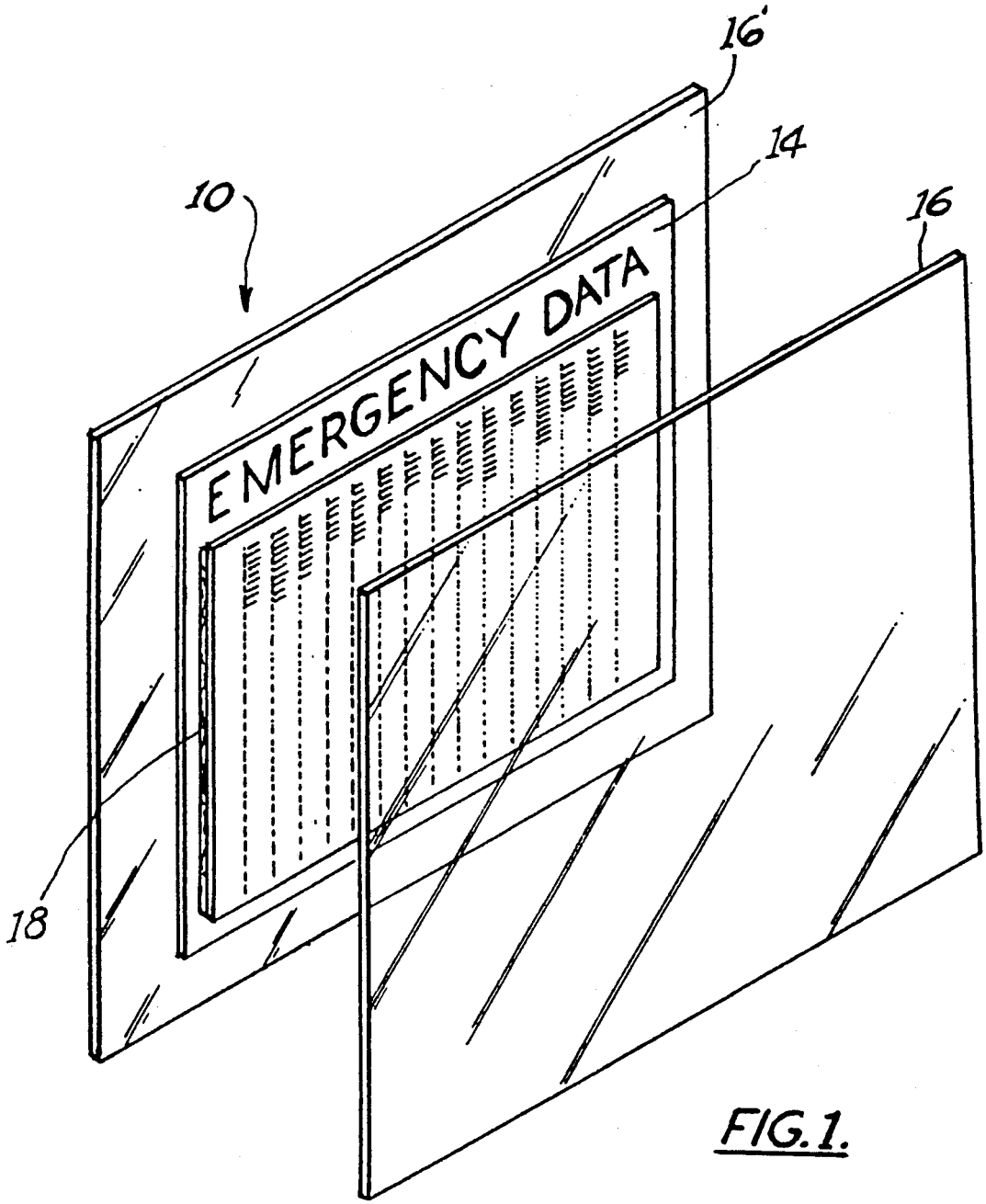
FIG. 1 shows the perspective view of a medical card in accordance with the present invention, partially exploded.

Referring now to the drawings, and specifically FIG. 1, the present invention is shown generally at 10 comprised of a completed medical data form 12' which has been reduced twice in a copy machine approximately 68% the first time from a full sheet of letter size paper and a second time approximately 68% to achieve a smaller than credit card size sheet of paper 12'. The information on the sheet of paper 12' was filled in either in longhand or by typing by the user and represents specific medical information based on that particular individual. The less than credit card size piece of paper 12' is then trimmed from the size of the copy machine paper after its reduction and mounted by glue 18 on a rigid plastic card 14 that is credit card size for carrying in the wallet that says "Emergency Data" or could say "Emergency Medical Data" permanently embossed or printed on the plastic card. Thus, the double reproduction of the information sheet 12' is sized to fit perfectly on the plastic rigid card 14. Although glue 18 has been shown to affix the sheet 12' to the plastic card 14, it is possible that just using clear plastic sheets 16 and 16' which are laminated together could possibly be used. The laminate plastic 16 and 16' act to protect the information sheet 12' and the plastic card 14 without reducing the overall size so that the ultimate laminated card is conveniently sized to be carried in a wallet like a credit card.

The method used for the invention that allows for total convenience and a self-prepared emergency data card by the particular individual begins with an 8"×11½" sheet of paper which is a form that is preprinted and provided to the user and the person who is creating his own emergency medical data card. In particular, the central emergency medical data contained on the form includes name, address, birth information, emergency notification, telephones to call in case of emergency, physicians, blood type, specific types of diseases which can be checked, whether the person is wearing contact lenses, and then specific spaces for particular individualized disorders that are blank spaces to be filled in by the user, particular allergies that can be filled in, particular medications being taken, important information concerning organ donors (yes or no), and the organ donor agency. It is also signed by the person and could have certain medical certification that is permitted by the person and the date. Thus, the form might also be used for particular procedures in a hospital if the person bearing the card is unconscious to provide permission to the hospital.

Figure 2:
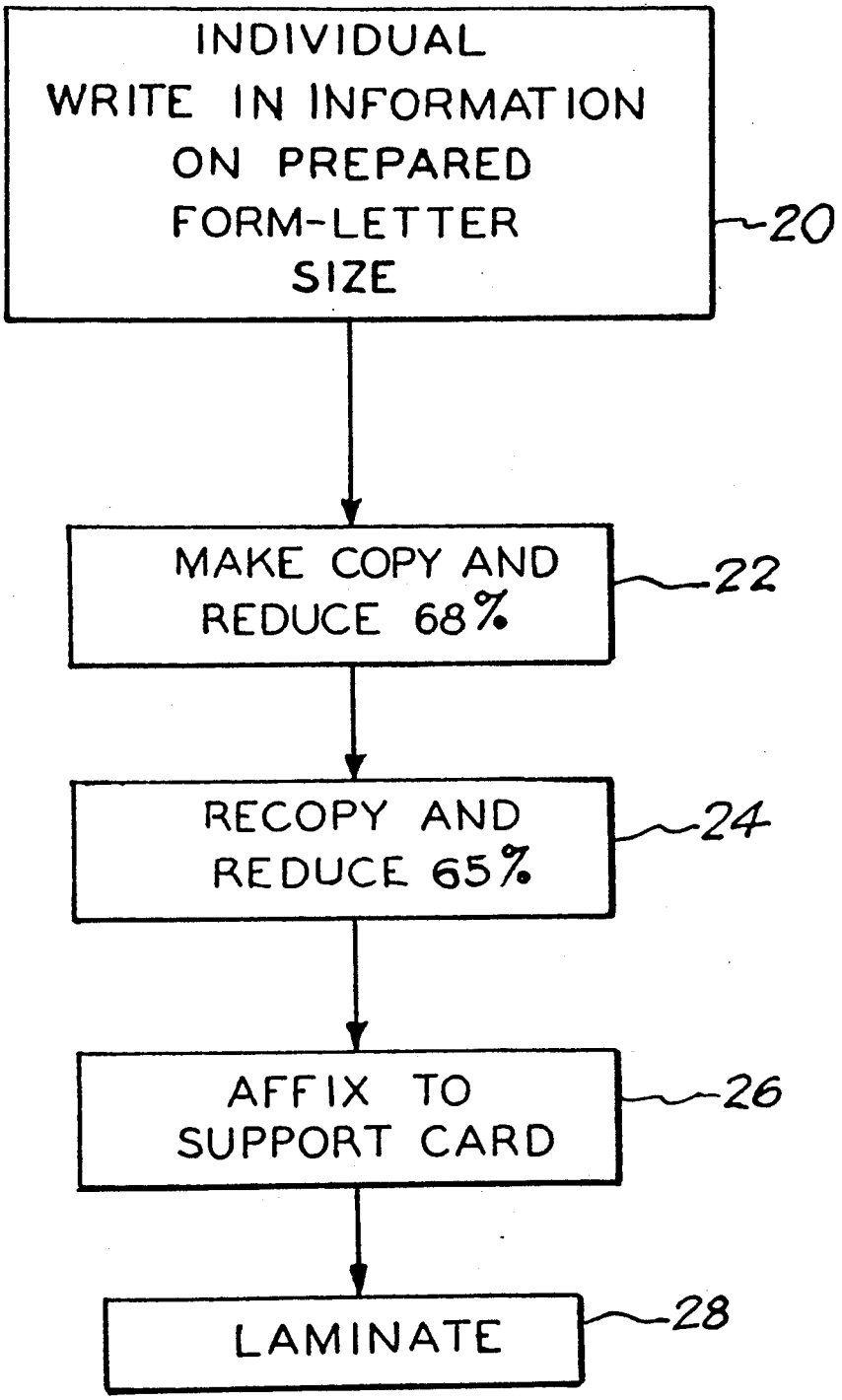
FIG. 2 shows a flow diagram of the reduction process in two steps for the present invention.

Once the form has been filled in, in longhand or it could be typed, by the user, then as shown in FIG. 2, the individual writes in information on a prepared form that is letter size. The individual then goes to a copy machine and reduces it approximately 68%. That copy is then recopied and reduced another 65%. The resultant sheet of paper will include a greatly reduced information or indicia area from the original form letter size. The reduced form is then cut away from the resultant copy sheet and affixed to the rigid plastic support card that contains permanent indicia stating emergency medical data. After the information sheet has been attached to the card, the card can then be laminated for protection while still being sized so that the final laminated card can be received in the wallet.

Figure 4:
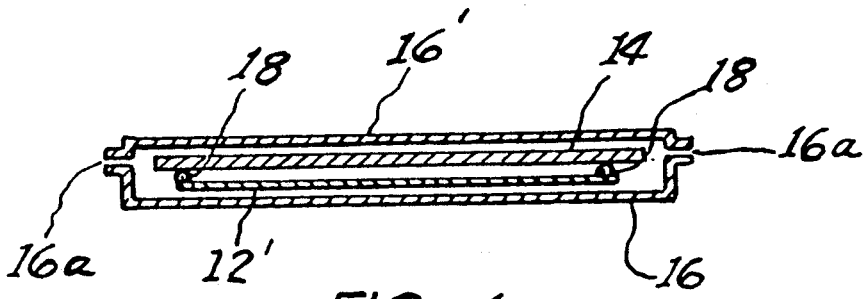
FIG. 4 shows a top plan cross-sectional view of the final product in accordance with the present invention.

Referring now to FIG. 4, the structure of the resultant card is shown as being wallet size having laminate plastic that is clear fused together along end portions 16*a* and encompassing and embodying around its perimeter a rigid piece of plastic 14 that has strategically sized, permanently embossed lettering such as "Emergency Data" or "Emergency Medical Data" along one small area with sufficient blank size to receive a greatly reduced form that has been filled out and that can be attached thereto or held in place by the laminate. The sheet 12' is shown attached to a rigid support card 14.

One of the problems with very important information sources, such as emergency medical data cards, is the convenience or nuisance value of getting such a card made. Typically, doctors' offices do not want to be bothered or do not have the time because of busy patient loads. Also, other professional organizations may require someone to provide confidential information in a non-medical environment that people may not wish to provide.

In the present invention, the actual user or the person whose information is provided can literally provide for his own card which can be sold either in a kit form with the laminate, the clear plastic, and the simple form. Thus, an individual can, through ultimate privacy, provide his own card that contains emergency medical data without going through the inconvenience of professional organizations and without loss of privacy.

What I claim is:

1. An emergency medical data card that is wallet sized that contains an individual's personal medical information comprising:

a rigid plastic thin credit card sized card for receipt into a wallet or the like;

a form beginning with a letter size sheet of paper containing indicia and blank lines for completion, relating to specific information of an individual, including name, address, and medical information, the indicia including lines to be filled in by an individual, said sheet being reduced, by a conventional copier, in a copy reproduction size to a specific size in accordance with said rigid plastic sized card after it has been filled in for attachment to said rigid plastic card, the indicia and filled in information after reduction being readable to a human eye without machine intervention; and a means for attaching said sheet of paper after it has been reduced to said plastic card.

2. An emergency medical data card as in claim 1, including clear laminate plastic means covering the front and back of said card to protect the information on said card and said sheet of paper.

3. The process of making an emergency medical data card by an individual for privacy and convenience comprising the steps of:

(a) preparing a medical data form that includes indicia having specific personalized medical information, including name, address, and medical data and sufficient blank spaces adjacent the indicia defined by indicia lines that allow an individual to complete and fill in his own medical information on a letter size form;;

(b) reproducing said letter size form in a copy machine and reducing said filled in form to obtain a slightly smaller than a credit card sized reproduction, the indicia and filled in information after reduction being readable to a human eye without machine intervention;

(c) cutting said reproduced form to a size smaller than wallet size;

(d) affixing said reproduced form to a rigid plastic support card; and (e) laminating said sheet and said card together with clear plastic surface covers.

4. A kit for creating an individualized, personalized medical data card in complete privacy comprising:

a rigid plastic card;

adhesive means;

a letter sized indicia-bearing sheet having personalized individual information, including name, address, and medical data, including blank forms to be filled in by the individual adjacent said indicia; and a means for laminating clear plastic sheets to both sides of said card to protect said information sheet, whereby the individual fills in the information on the medical data sheet and then reduces it in a reproduction or copy machine to a size slightly smaller than the credit card wallet size plastic support card and attaches the information sheet to the support card, the filled in information after reduction being readable by a human eye without machine intervention.

* * * * *